US007839979B2

(12) United States Patent
Hauttmann et al.

(10) Patent No.: US 7,839,979 B2
(45) Date of Patent: Nov. 23, 2010

(54) ELECTRON OPTICAL APPARATUS, X-RAY EMITTING DEVICE AND METHOD OF PRODUCING AN ELECTRON BEAM

(75) Inventors: Stefan Hauttmann, Eindhoven (DE); Wolfram Maring, Eindhoven (DE); Steffen Holzapfel, Eindhoven (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 12/444,745

(22) PCT Filed: Oct. 8, 2007

(86) PCT No.: PCT/IB2007/054087

§ 371 (c)(1),
(2), (4) Date: Apr. 8, 2009

(87) PCT Pub. No.: WO2008/044194

PCT Pub. Date: Apr. 17, 2008

(65) Prior Publication Data

US 2010/0020937 A1 Jan. 28, 2010

(30) Foreign Application Priority Data

Oct. 13, 2006 (EP) ..... 06122223

(51) Int. Cl.
*H01J 35/30* (2006.01)
*H01J 35/14* (2006.01)

(52) U.S. Cl. ..... 378/137; 378/138

(58) Field of Classification Search ..... 378/119, 378/137, 138, 199, 200
See application file for complete search history.

(56) References Cited

U.S. PATENT DOCUMENTS

| | | | | |
|---|---|---|---|---|
| 3,731,241 | A | 5/1973 | Coupland | |
| 4,851,737 | A | 7/1989 | Johansson et al. | |
| 5,682,412 | A | 10/1997 | Skillicorn et al. | |
| 6,181,771 | B1 | 1/2001 | Hell et al. | |
| 6,292,538 | B1 | 9/2001 | Hell et al. | |
| 7,186,022 | B2 * | 3/2007 | Charles et al. | 378/200 |
| 2002/0009179 | A1 | 1/2002 | Hess et al. | |
| 2003/0025429 | A1 | 2/2003 | Hell et al. | |
| 2007/0051907 | A1 | 3/2007 | Reinhold | |

FOREIGN PATENT DOCUMENTS

| | | |
|---|---|---|
| EP | 0421523 | 4/1991 |
| EP | 0507383 | 10/1992 |
| EP | 1760760 | 8/2006 |
| JP | 01151141 | 6/1989 |
| JP | 05067442 | 3/1993 |
| WO | WO02099834 | 12/2002 |

* cited by examiner

*Primary Examiner*—Irakli Kiknadze

(57) ABSTRACT

It is described an electron optical arrangement, a X-ray emitting device and a method of creating an electron beam. An electron optical apparatus (1) comprises the following components along an optical axis (25): a cathode with an emitter (3) having a substantially planar surface (9) for emitting electrons; an anode (11) for accelerating the emitted electrons in a direction essentially along the optical axis (25); a first magnetic quadrupole lens (19) for deflecting the accelerated electrons and having a first yoke (41); a second magnetic quadrupole lens (21) for further deflecting the accelerated electrons and having a second yoke (51); and a magnetic dipole lens (23) for further deflecting the accelerated electrons.

15 Claims, 6 Drawing Sheets

ELECTRON OPTICAL APPARATUS, X-RAY EMITTING DEVICE AND METHOD OF PRODUCING AN ELECTRON BEAM

FIELD OF THE INVENTION

The present invention relates to an electron optical apparatus for producing an electron beam, to an X-ray emitting device and to a method of producing an electron beam.

TECHNICAL BACKGROUND

The future demands for high-end computer tomograph (CT) and cardiovascular (CV) imaging regarding the X-ray source are (1) higher power/tube current, (2) smaller focal spots combined with the ability of active control of the size, ratio and position of the focal spot, (3) shorter times for cooling down, and, concerning CT, (4) shorter gantry rotation times. In addition to this, the tube design is limited in length and weight to achieve an easy handling for CV applications and a realisable gantry setup for CT applications.

One key to reach higher power and faster cooling is given by using a sophisticated heat management concept inside the X-ray tube. In conventional bipolar X-ray tubes about 40% of the thermal load of the target is due to electrons backscattered from the target, which are reaccelerated towards the target and hitting it again outside the focal spot. Hence these electrons contribute to the temperature increase of the target and cause off-focal radiation. Therefore one key component of a currently developed new X-ray tube generation is a scattered electron collector (SEC) located in front of the target. Introducing this component in combination with a unipolar tube setup causes an electrical field-free region above the target if both elements—target and SEC—are on the same potential. The thermal load of the target is in this case determined only by electrons contributing to the tube's X-ray output. The backscattered electrons release their energy at the SEC which is integrated into the tube's cooling system.

Conventionally, this setup including a SEC enhances the distance between anode and cathode but leaves no space for focusing elements. Compared to prior X-ray tubes this causes a drastically enlarged electron beam path making the focusing of the electron beam more advanced.

One major goal of new high-end X-ray tubes for medical examinations is to provide variable and small focal spot sizes and positions within a high voltage range of U=60-150 kV and tube currents up to I=2A. Additionally limitations in the tube size with an optical length of $l<130$ mm have to be taken into account.

Image quality issues in CT or CV imaging require the possibility of an active control of the focal spot size during image acquisition. New imaging modalities in CT like dynamic focal spot (deflection in tangential and radial direction) which help to increase spatial resolution or to reduce artifacts need in addition the ability of active focal spot position control.

For satisfying the above and other requirements, there may be a need for an improved electron optical apparatus for producing an electron beam, an improved X-ray emitting device and an improved method for producing an electron beam.

SUMMARY OF THE INVENTION

This need may be met by the subject matter according to the independent claims. Advantageous embodiments of the present invention are described by the dependent claims.

According to a first aspect of the invention there is provided an electron optical apparatus comprising the following components along an optical axis, preferably in the indicated order: a cathode including an emitter having a planar surface for emitting electrons; an anode for accelerating the emitted electrons in a direction essentially along the optical axis; a first magnetic quadrupole lens for deflecting the accelerated electrons and having a first yoke; a second magnetic quadrupole lens for further deflecting the accelerated electrons and having a second yoke; and a magnetic dipole lens for further deflecting the accelerated electrons.

This aspect of the invention is based on the idea to combine into an electron optical apparatus the advantages of a double quadrupole lens consisting of a first magnetic quadrupole lens and a second magnetic quadrupole lens and the advantages of a thin, flat and unstructured or only slightly structured emitter. The double quadrupole provides excellent focusing properties. The flat emitter having a planar surface for emitting electrons provides for a reduced lateral energy component of the emitted electrons thereby also contributing to excellent focusing properties of the electron optical apparatus. Furthermore, to fulfill the requested variable focus spot position, a magnetic dipole lens is provided for deflecting the emitted electrons in transversal and radial directions.

In the following, features and advantages of the electron optical apparatus according to the first aspect will be described in detail.

Herein, an electron apparatus shall be defined as comprising both a cathode including an emitter as a source of free electrons, an anode for accelerating the provided free electrons thereby creating a beam of electrons, and an electron optics for deflecting the accelerated free electrons thereby focusing and/or deflecting the beam of electrons. The main direction into which the free electrons are accelerated by the anode can be defined as an optical axis of the electron optical apparatus.

The emitter has a substantially planar surface for emitting electrons. Herein, "substantially planar" means that the surface includes no significant curvatures, openings or protrusions and is substantially flat, smooth and substantially unstructured. However, there may be fine structures within the planar surface such as grooves or recesses. The depth of such structures may be significantly less than the dimensions of the surface. For example, the depth of the structures can be less than 10%, preferably less than 1%, of the length of the surface. The emitter can be in the form of an flat foil. The emitter can be prepared with a refractory and electrically conductive material such as for example tungsten or a tungsten alloy.

The emitter can be heated by applying a voltage and thereby inducing a heating current within the emitter. Preferable the current is induced such that the emitting surface of the emitter is heated homogeneously. From the heated surface of the cathode electrons can be emitted. As the emitting surface of the cathode is planar the electrons can be emitted homogeneously. The average direction of electrons exiting from the emitting surface can be the same all over the emitting surface.

With conventional cathodes including e.g. tungsten coils or flat tungsten emitters with slits the non-planar structure of the cathode heavily distorts the electric potential between the cathode and the anode thereby increasing the velocity component of electrons transverse to the optical axis and hence increasing the focal spot size of the electron optical apparatus.

In an electron apparatus according to the present invention, as the emitting surface of the cathode is essentially planar an electric potential applied between the cathode and the anode can be homogeneous and is not distorted by structures on the cathode. Accordingly, electrons homogeneously emitted from the cathode surface can all be homogeneously accelerated along or parallel to the optical axis of the apparatus. This can contribute to a minimal focal spot of the electron optical apparatus.

The anode can be any conventional anode usable for generating an electric potential between the anode and the cathode. The electrical anode can have an opening in a region around the optical axis such that electrons accelerated within the generated potential can fly through this opening in the anode. For example the anode can have the form of a cup having an opening at the center. The cup can disembogue in a bottle neck which extends around the opening in a direction away from the cathode.

The first and the second magnetic quadrupole lenses can be constituted by electromagnetic devices which are arranged in a way to produce a magnetic quadrupole field. For example, four magnetic poles can be arranged at the corners of a square such that two magnetic south poles are arranged on diagonally opposite corners of the square and two magnetic north poles are arranged on the other corners.

Electromagnetic coils for the first and second magnetic lens can be arranged on first and second yokes, respectively. The yokes can be prepared with a ferromagnetic material for enhancing the created magnetic field. The yokes can have a geometry adapted such as to hold the electromagnetic coils at positions so as to create a magnetic quadrupole field. For example, the yokes can have a rectangular, square or round geometry. The yokes can have protrusions on which the electromagnetic coils are located.

The first and the second magnetic quadrupole lenses can have substantially the same geometry. Preferably, the two lenses are arranged in parallel with respect to each other. Furthermore, each of the lenses can be arranged perpendicular to the optical axis.

The purpose of the first and the second magnetic quadrupole lenses is to deflect the accelerated electrons such that the electron beam can be finally focused onto a probe. Each quadrupole lens creates a magnetic field having a gradient. I.e. the magnetic field intensity differs within the magnetic field. Equipotential surfaces of the quadrupole field can have a hyperbolic form. The gradient of a magnetic quadrupole is such that the magnetic quadrupole field acts as focusing the electron beam in a first direction whereas it acts as defocusing in a second direction perpendicular to the first direction. The two quadrupole lenses can be arranged such that their magnetic field gradients are rotated about 90° with respect to each other. After traversing both magnetic quadrupole lenses a line focus can be achieved which means that the electron beam is focused to an elongated spot having a length to width ratio of e.g. more than 5. For this purpose, the magnetic fields of the first and the second magnetic quadrupole lenses might have a symmetry with respect to the optical axis or with respect to a plane through the optical axis.

The magnetic dipole lens can be provided by one or more magnetic dipole coils. In order to obtain a homogeneous magnetic dipole field, two magnetic coils can be provided. They can be arranged in a plane perpendicular to the optical axis of the electron optical apparatus and at opposite positions with respect to the optical axis.

The purpose of the dipole lens is to provide a substantially homogeneous magnetic field in order to deflect the accelerated electrons in a way so as to shift the focus of the electron beam on a probe.

According to a an embodiment of the invention the magnetic dipole lens comprises dipole coils which are arranged on the yoke of the second magnetic quadrupole lens. By arranging the dipole coils on this second yoke the magnetic dipole field can be directly superimposed to the magnetic quadrupole field of the second quadrupole lens. The second yoke can serve both as a yoke for the second quadrupole lens and as a yoke for the dipole lens. Thereby space can be saved and the length of the entire electron optical apparatus can be reduced. Furthermore the weight for an additional yoke can be saved.

According to a further embodiment of the invention the electron optical apparatus comprises a scattered electron collector (SEC). The SEC is adapted to collect backscattered electrons created on the impact of accelerated electrons coming from the electron optical apparatus. The accelerated electrons hit the surface of a probe such as an anode disc of an X-ray emitting device. Some of these electrons are reflected. Other electron free secondary electrons from the probe. All these backscattered electrons fly away from the probe and to the SEC where they are collected. The SEC can be positioned downstream of the second quadrupole lens i.e. at an end of the electron optical apparatus opposite to the cathode.

The SEC can be prepared with an electrically conductive material. An electric voltage can be applied to the SEC such that the SEC and the anode are on the same electric potential. For example, the SEC can be electrically connected to the anode. The SEC can have the form of an inverse cup having an opening in a center through which the electron beam can pass. The SEC can be continuous to a bottle neck of the anode cup.

According to a further embodiment of the invention each of the components such as the cathode including the emitter, the anode, the first and the second magnetic quadrupole lenses and the magnetic dipole lens and optionally the scattered electron collector has a symmetry with respect to the optical axis. The components can be arranged co-axially with respect to the optical axis. Using such symmetrical arrangement the design of the electron optical apparatus can be simplified. Furthermore, a defined and symmetric focal spot can be achieved.

According to a further embodiment of the invention the electron optical apparatus has a length along the optical axis of less than 90 mm and preferably between 70 mm and 90 mm. Including the scattered electron collector the length of the electron optical apparatus can be adapted to be no longer than 150 mm or preferably between 120 mm and 150 mm. This short length can be achieved by using flat space saving components such as the flat emitter and by advantageously arranging the components of the apparatus. For example, the magnetic dipole lens can be integrated into the second quadrupole lens thereby saving space in the direction of the optical axis. Having such short length the electron optical apparatus is particularly well suited for applications with space or weight restrictions such as CT or CV applications.

According to a further embodiment of the invention the planar surface of the emitter is non-structured. In other words, the surface of the emitter from which the electrons can be emitted towards the anode is a homogeneous plane without any recesses or protrusions. Electrons can be emitted homogeneously from such non-structured surface. Furthermore, such non-structured emitter surface does not disturb the electric field between the cathode including the emitter and the anode. Especially the electric field close to the surface of the emitter is not disturbed by any structures. Accordingly, electric field lines remain linear and electrons are accelerated parallely to the optical axis without any substantial transversal moving component. The electron beam is not widened. This can help in better focusing of the electron beam.

According to a further embodiment of the invention the planar surface of the emitter is finely structured. In other words, fine structures such as e.g. grooves, slits or recesses are located within the planar surface of the emitter. These fine structures can be used e.g. for confining an electrical current within the emitter which is used to electrically heat the emitter. However, the size and/or arrangement of such fine structures can be chosen such that the emitted electrons are not excessively scattered and such that the electric field is not excessively distorted.

According to a further aspect of the invention there is provided an X-ray emitting device comprising the following component along an optical axis: an electron optical apparatus as described above; and an anode disc arranged such that the accelerated electrons impact on a electron receiving surface of the anode disc.

The anode disc can have a slanted surface onto which the electron beam coming from the electron optical apparatus can be directed. Electrons impacting the surface of the anode disc and entering the anode material produce X-ray radiation. The angle of the slanted surface of the anode disc can be selected such that the X-rays are emitted transversely, preferably perpendicularly, to the optical axis of the electron optical apparatus.

The anode disc can be prepared with a selected material in order to receive desired X-ray characteristics. The anode disc can be rotated about an axis parallel to the optical axis of the electron optical apparatus.

According to a further embodiment of the invention the electrical anode and the anode disc (=target) are essentially on the same electric potential. In case that a scattered electron collector is provided also this SEC can be set on the electrical potential of the anode. Accordingly, the region between the anode and the anode disc can be free of any electric field. By eliminating any electric field in the proximity of the surface of the anode disc it can be prevented that backscattered electrons coming from the surface of the anode disc are reattracted towards the anode disc. Otherwise, these reattracted backscattered electrons would unnecessarily widen the focal spot and would furthermore contribute to heating of the anode disc thereby increasing the cooling requirements for the anode disc.

According to a further embodiment of the invention the cathode including the emitter, the electrical anode, the first magnetic quadrupole lens, the second magnetic quadrupole lens, the optional scattered electron collector and the anode disc are all connected to a water cooling circuit. A combined water cooling circuit can be used for cooling all component except the cathode including the emitter. The water in the cooling circuit is electrically conductive but when the mentioned components are preferably all on ground potential no further measures for electrically insulating the cooling circuit and the components has to be provided.

According to a further embodiment of the invention a distance from the electron emitting surface of the emitter to a electron receiving surface of the anode disc is less than 150 mm and preferably between 120 mm and 150 mm. As outlined above, this can be achieved by special selection of the constituent component and the arrangement of the components.

According to a further aspect of the invention there is provided a medical X-ray device comprising an X-ray emitting device as outlined above. The medical X-ray device can be for example a computer tomograph or a cardiovascular imaging device. As outlined above such medical devices can have severe requirements in terms of focal spot size, control of the focal spot size, ratio and position, cooling down times and, concerning CTs, gantry rotation times. Using an X-ray emitting device as outlined above these requirements can be met.

According to a further aspect of the invention there is provided a method of creating an electron beam, the method comprising the steps of: emitting electrons from a planar surface of a emitter; accelerating the electrons in a direction essentially parallel to the optical axis using an anode; deflecting the accelerated electrons using a first magnetic quadrupole lens; further deflecting the accelerated electrons using a second magnetic quadrupole lens; further deflecting the accelerated electrons using a magnetic dipole lens.

Exemplary embodiments of the present invention are described with reference to an electron optical apparatus or an X-ray emitting device. It has to be pointed out that of course any combination of features relating to different subject matters is also possible and that the features of the apparatus or device can be applied correspondingly to the method according to the invention.

It has to be noted that embodiments of the invention are described with reference to different subject matters. In particular, some embodiments are described with reference to apparatus type claims whereas other embodiments are described with reference to method type claims. However, a person skilled in the art will gather from the above and the following description that, unless other notified, in addition to any combination of features belonging to one type of subject matter also any combination between features relating to different subject matters, in particular between features of the apparatus type claims and features of the method type claims is considered to be disclosed with this application.

The aspects defined above and further aspects, features and advantages of the present invention can be derived from the examples of embodiment to be described hereinafter and are explained with reference to the examples of embodiment. The invention will be described in more detail hereinafter with reference to examples of embodiment but to which the invention is not limited.

DETAILED DESCRIPTION

Figure 1B:
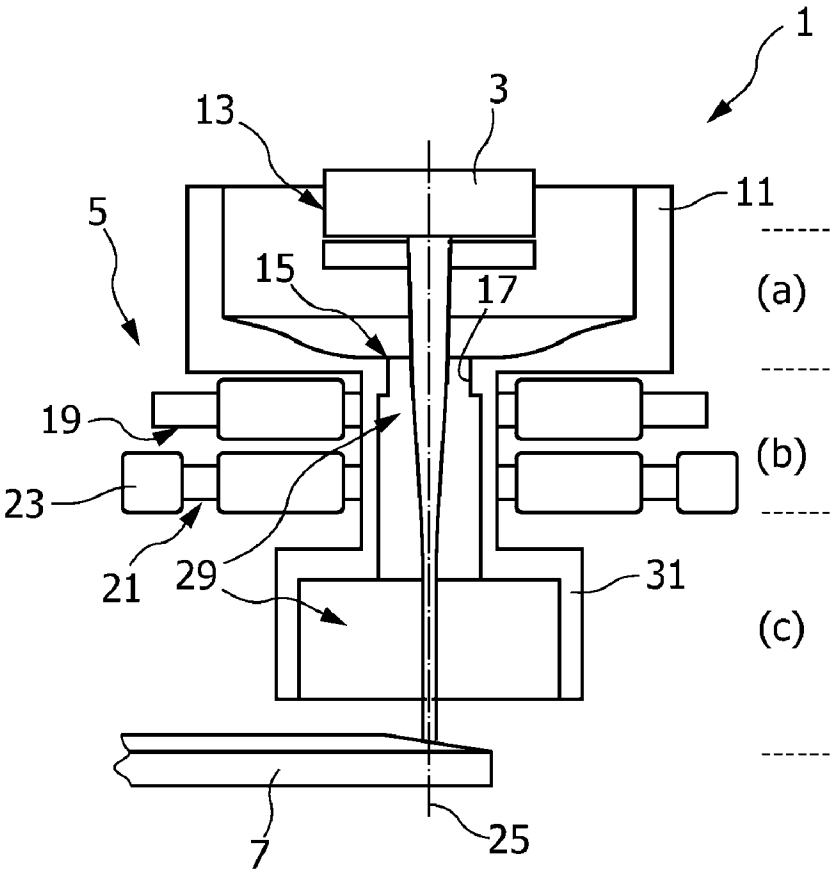
FIG. 1*b* shows the schematic setup of FIG. 1*a* in cross-section perpendicular to a length direction.

The illustration in the drawing is schematically. It is noted that in different figures, similar or identical elements are provided with the same reference signs or with reference signs, which are different from the corresponding reference signs only within the first digit.

Future X-ray medical examinations have sophisticated requirements on the spot sizes and shapes in combination with fast changes in positions. Due to the limitations in space of typically 130 mm in optical length and an optimal heat management by implementing a SEC, a much better electron optic than usually used in X-ray tubes is necessary.

Figure 1A:
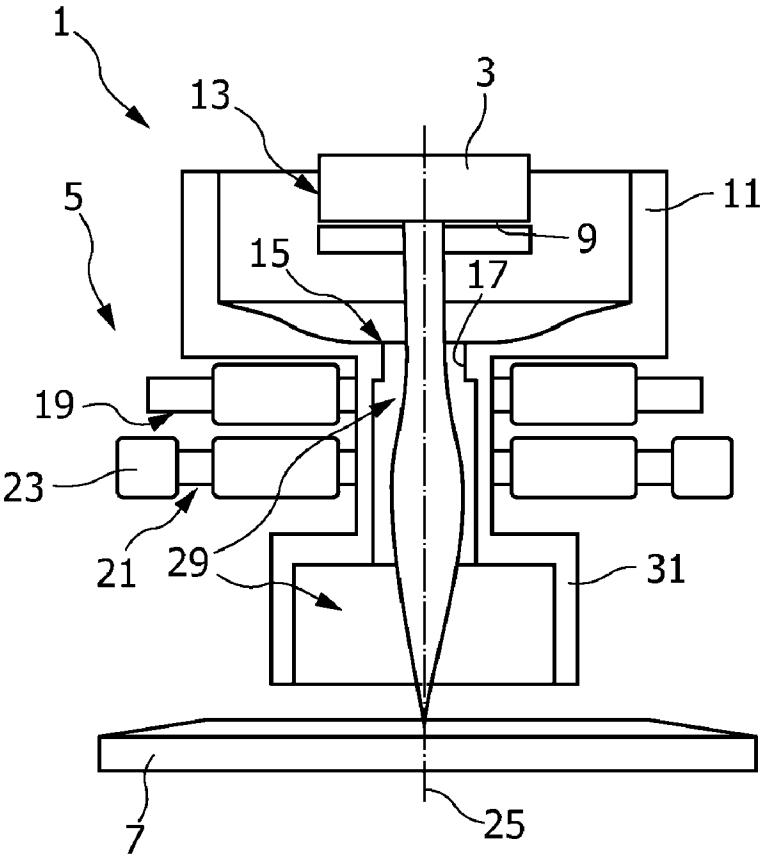
FIG. 1*a* shows a schematic setup of an X-ray emitting device according to the present invention in cross-section perpendicular to a width direction.

FIGS. 1*a* and 1*b* show an embodiment of an X-ray emitting device 1 according to the invention. The proposed X-ray emitting device to reach the above requirements comprises a cathode with a flat emitter 3 as an electron source and a lens system 5.

The objective of spot control is to create a line focus (an elongated spot) on the slanted part of an anode disc 7 in such a way that the effective X-ray source has an approximately equal size in width and length dimension when viewed from an X-ray exit window. To achieve this, the spot length has to be enlarged by a factor (typically around 8) with respect to the width depending on the anode slant angle (typically around 8°).

Both optical parts, cathode with emitter 3 and lens system 5, have to be optimal to fulfill the high requests for new state-of-the-art X-ray tubes. The first essential step is to reduce the tangential energy components of the emitted electrons. This is reached by emitting the electrons from a flat, smooth and unstructured tungsten or tungsten alloy foil emitter within the cathode 3 which is directly heated by an applied electrical current. The emitter 3 has a planar surface 9 directed towards an anode 11.

A first pre-focusing element in length and width direction is given by a cathode cup 13 with a ring on high potential. The entrance into the electrical anode opening 15 acts as a second optical element having an isotropic defocusing effect. It has a entrance diameter of typically 20 mm and enlarges within a bottle-neck 17 up to 30 mm to give room for an uncritical electron beam shaping.

The main optical component, the double magnetic quadrupole lens including a first magnetic quadrupole lens 19 and a second magnetic quadrupole lens 21, is positioned approximately in the middle between the cathode 3 and the target anode disc 7 around the bottle-neck 17. It consists of a cathode side first quadrupole lens 19 and an anode side second quadrupole lens 21 with integrated dipole lens 23 enabling a shifting of the focal spot in x/z-direction, i.e. a plane perpendicular to an optical axis 25 of the X-ray device 1. The first magnetic quadrupole lens 19 focuses in length and defocuses in width direction of the focal spot. The electron beam is then focused in width direction and defocused in length direction by the following second quadrupole lens 21. In combination the two sequentially arranged magnetic quadrupole lenses guarantee a net focusing effect in both directions of the focal spot which is also demonstrated in FIG. 1. This mode of operation of the double magnetic quadrupole lens leads to the required narrow line focus on the target anode disc 7 with typical length to width relations between 7 and 10.

Additionally this concept leaves an electrical field-free and hence optical-free region 29 of more than 40% of the total distance between cathode 3 and target anode disc 7 to accommodate a scattered electron collector 31 for the heat management of scattered electrons.

In FIG. 1*b*, the region (a) indicates an emitting and acceleration length, the region (b) indicates a focusing and beam shaping length and the region (c) indicates a scattered electron collector and heat management length.

Figure 2:
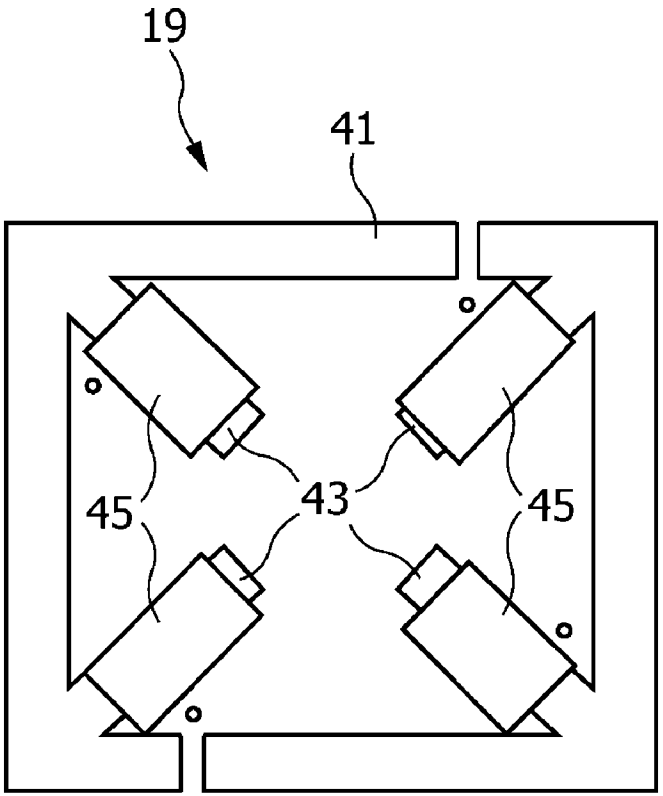
FIG. 2 shows a magnetic quadrupole lens which can be used as first magnetic quadrupole lens in the setup of FIG. 1*a*.

FIG. 2 shows a top view of the first magnetic quadrupole lens 19. A square yoke 41 comprises protrusions 43 directed to the center of the square. On each of these four protrusions 43 a magnetic coil 45 is provided.

Figure 3:
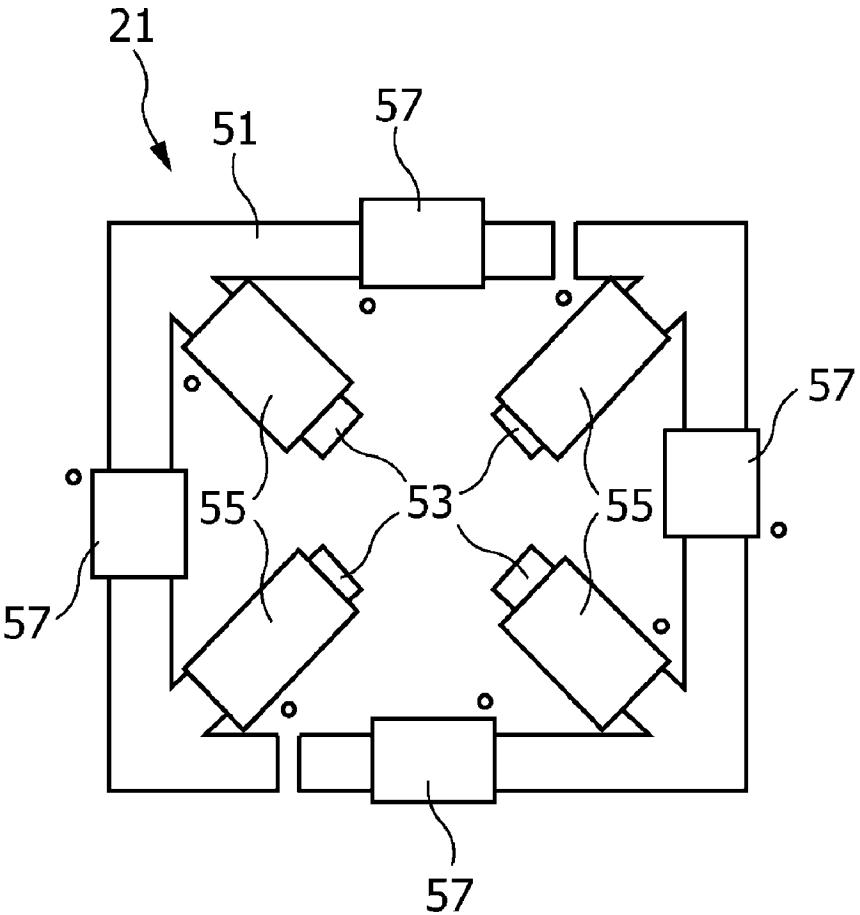
FIG. 3 shows a magnetic quadrupole lens including a magnetic dipole lens which can be used as second magnetic quadrupole lens in the setup of FIG. 1*a*.

Similarly, FIG. 3 shows a top view of the second magnetic quadrupole lens 21. A square yoke 51 comprises protrusions 53 directed to the center of the square. On each of these four protrusions 53 a magnetic coil 55 is provided. Furthermore, a magnetic coil 57 for forming a magnetic dipole lens 23 is arranged in the center of each of the longitudinal arms of the square yoke 51.

The disclosed setup requires a beam path length of approximately 130 mm which is drastically larger than in common bipolar tubes (>>20 mm) but it still allows the manufacturing of tubes small and light enough to be used for CV-applications and to fit onto common CT-gantries.

Figure 4:
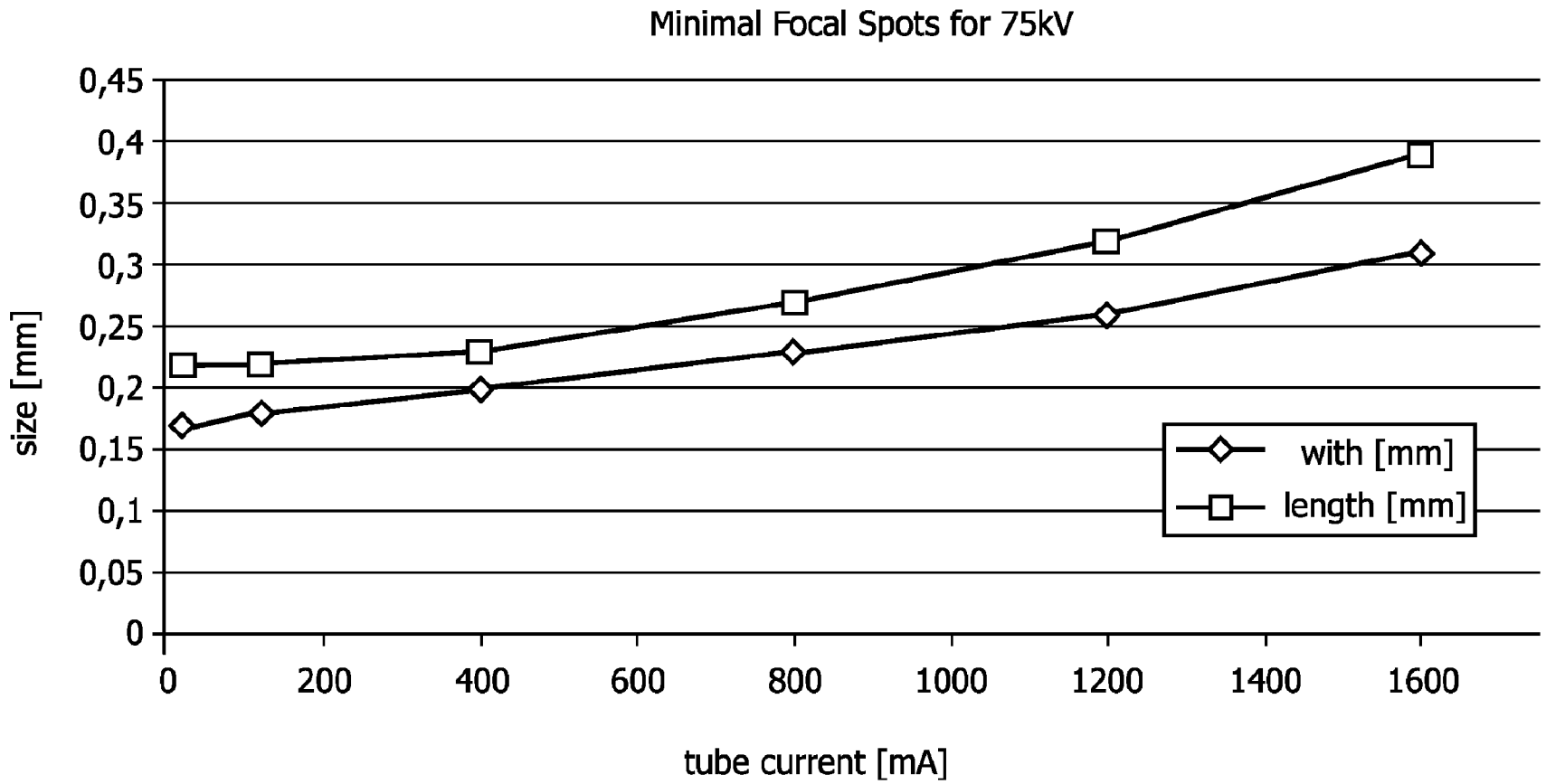
FIG. 4 shows a diagram indicating length and width of area-minimized focal spots for different tube currents achievable with an X-ray emitting device according to the invention.

The resulting smallest foci using an emission area of 50 $mm^2$ are shown in FIG. 4 as a function of tube current. It is obvious that these foci are outstanding small with respect to the tube currents in comparison to every other X-ray tube used today for medical examinations. Enlarging these minimal focal spots by independently changing length and width at a given tube current can easily be done by only controlling the coil currents of the two magnetic quadrupole lenses 19, 21.

Experiments have been performed to investigate how strong the influence of the electron emitting emitter on the optical properties is. With an X-ray emitting device using an emitter having an unstructured emitting surface of 50 $mm^2$ a focal spot width of 0.2 mm and a focal spot length of 0.23 mm could be obtained. With an X-ray emitting device using an emitter having a slightly structured emitting surface of 50 $mm^2$ with 20×40 μm slits in width direction, a focal spot width of 0.3 mm and a focal spot length of 0.46 mm could be obtained. Using the fine structured emitter having the same emission area like the unstructured one but using a meander design with 20 slits of 40 μm in width to create a current path leads to significantly larger spot sizes. The focal spot width enlarges by 50% and the focal spot length by 100% for the smallest spot. The stronger influence on the length is caused by electrons emitting from the inner slit walls which are orientated in width direction.

For a commonly used coil emitter this effect even drastically increases: The smallest projected focal spot area ($0.513\times0.946\ mm^2=0.485\ mm^2$ for 8° slant angle) for a tube current of only 240 mA and 120 kV is more than ten times compared to the unstructured emitter setup.

Figures 5A, 5B, 5C:
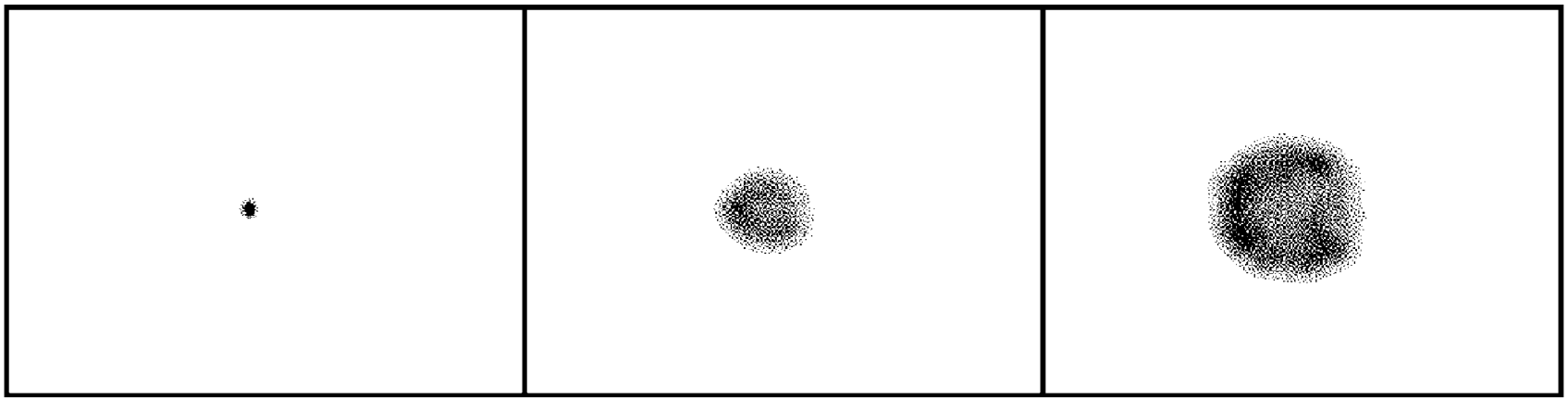
FIGS. 5*a*, 5*b* and 5*c* visualize different focal spots for CT applications.

To further demonstrate the possibilities of the electron optical concept, three focal spots adjusted to sizes for near future CV and CT applications are shown in FIG. 5. FIG. 5*a* shows a IEC 03 focal spot for CV applications; FIG. 5*b* shows a $0.75\times0.9\ mm^2$ focal spot for CT applications; and FIG. 5*c* shows a $1.30\times1.45\ mm^2$ focal spot for CT applications.

Figure 6:
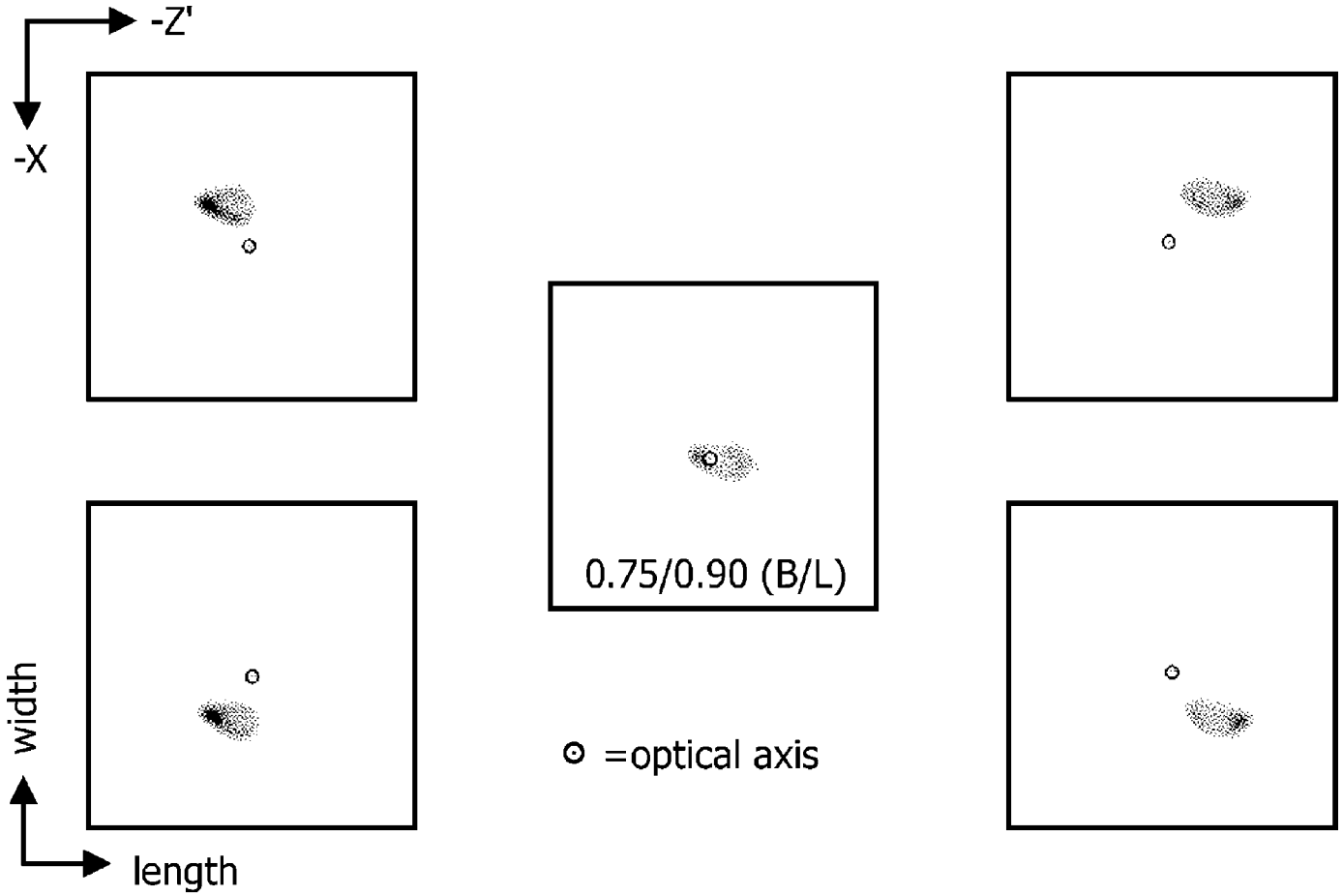
FIG. 6 visualizes different focal spot positions achieved by applying specific currents to the magnetic dipole lens of an X-ray emitting device according to the invention.

Shifted focal spots by means of the dipoles integrated on the second yoke in X and Z-direction are shown in FIG. 6.

Figure 7:
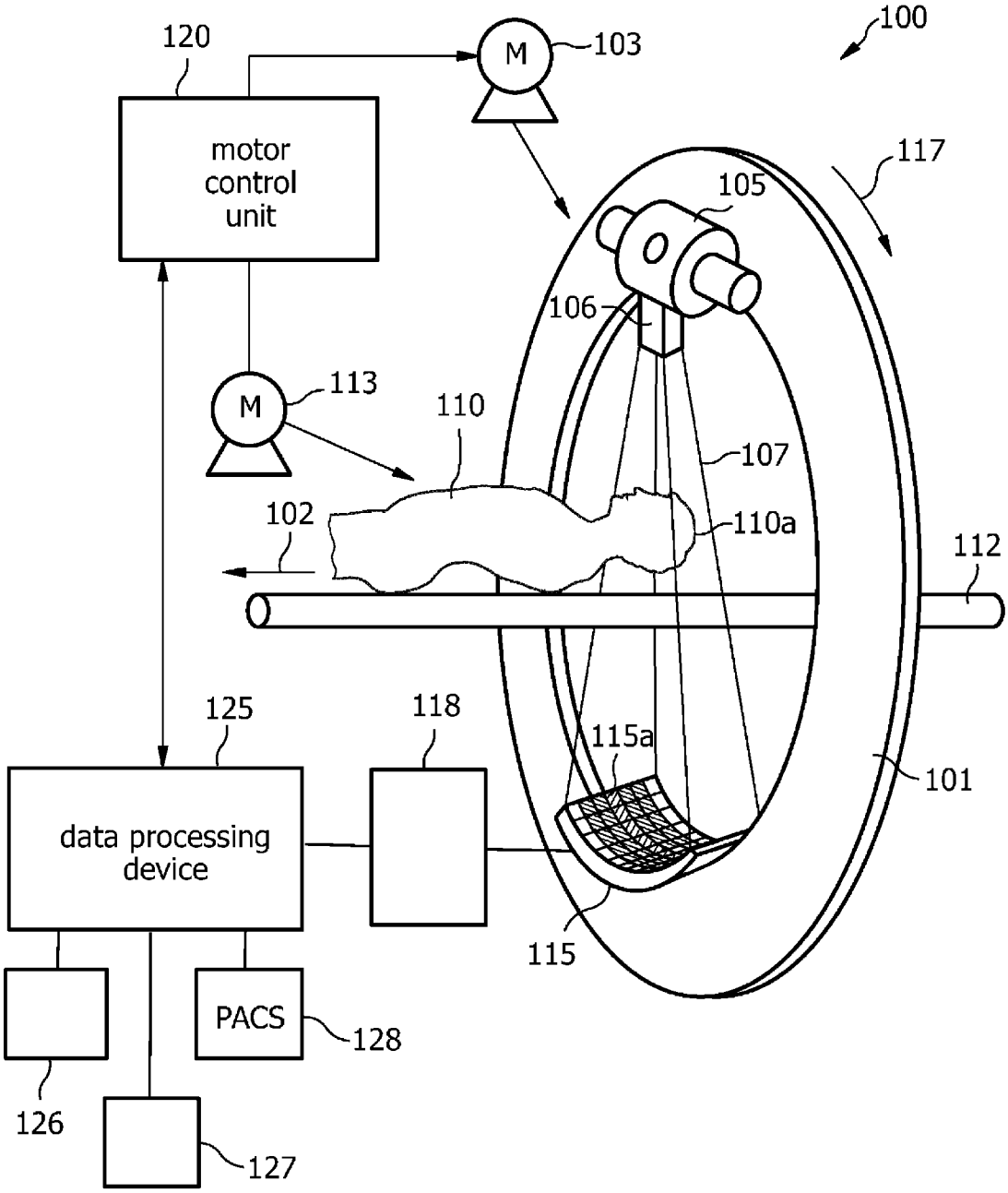
FIG. 7 schematically shows a computer tomography device according to the invention.

Finally, FIG. 7 shows a computer tomography apparatus 100, which is also called a CT scanner and in which the above X-ray emitting device can be used. The CT scanner 100 comprises a gantry 101, which is rotatable around a rotational axis 102. The gantry 101 is driven by means of a motor 103.

Reference numeral 105 designates a source of radiation such as an X-ray emitting device as described above, which emits polychromatic radiation 107. The CT scanner 100 further comprises an aperture system 106, which forms the X-radiation being emitted from the X-ray source 105 into a radiation beam 107. The spectral distribution of the radiation beam emitted from the radiation source 105 may further be changed by a filter element (not shown), which is arranged close to the aperture system 106.

The radiation beam 107, which may by a cone-shaped or a fan-shaped beam 107, is directed such that it penetrates a region of interest 110*a* such as a head 110*a* of a patient 110.

The patient 110 is positioned on a table 112. The patient's head 110*a* is arranged in a central region of the gantry 101, which central region represents the examination region of the CT scanner 100. After penetrating the region of interest 110*a* the radiation beam 107 impinges onto a radiation detector 115. In order to be able to suppress X-radiation being scattered by the patient's head 110*a* and impinging onto the X-ray detector under an oblique angle there is provided a not depicted anti scatter grid. The anti scatter grid is preferably positioned directly in front of the detector 115.

The X-ray detector 115 is arranged on the gantry 101 opposite to the X-ray tube 105. The detector 115 comprises a plurality of detector elements 115*a* wherein each detector element 115*a* is capable of detecting X-ray photons, which have been passed through the head 110*a* of the patient 110.

During scanning the region of interest 110*a*, the X-ray source 105, the aperture system 106 and the detector 115 are rotated together with the gantry 101 in a rotation direction indicated by an arrow 117. For rotation of the gantry 101, the motor 103 is connected to a motor control unit 120, which itself is connected to a data processing device 125. The data processing device 125 includes a reconstruction unit, which may be realized by means of hardware and/or by means of software. The reconstruction unit is adapted to reconstruct a 3D image based on a plurality of 2D images obtained under various observation angles.

Furthermore, the data processing device 125 serves also as a control unit, which communicates with the motor control unit 120 in order to coordinate the movement of the gantry 101 with the movement of the table 112. A linear displacement of the table 112 is carried out by a motor 113, which is also connected to the motor control unit 120.

During operation of the CT scanner 100 the gantry 101 rotates and in the same time the table 112 is shifted linearly parallel to the rotational axis 102 such that a helical scan of the region of interest 110*a* is performed. It should be noted that it is also possible to perform a circular scan, where there is no displacement in a direction parallel to the rotational axis 102, but only the rotation of the gantry 101 around the rotational axis 102. Thereby, slices of the head 110*a* may be measured with high accuracy. A larger three-dimensional representation of the patient's head may be obtained by sequentially moving the table 112 in discrete steps parallel to the rotational axis 102 after at least one half gantry rotation has been performed for each discrete table position.

The detector 115 is coupled to a pre-amplifier 118, which itself is coupled to the data processing device 125. The processing device 125 is capable, based on a plurality of different X-ray projection datasets, which have been acquired at different projection angles, to reconstruct a 3D representation of the patient's head 110*a*.

In order to observe the reconstructed 3D representation of the patient's head 110*a* a display 126 is provided, which is coupled to the data processing device 125. Additionally, arbitrary slices of a perspective view of the 3D representation may also be printed out by a printer 127, which is also coupled to the data processing device 125. Further, the data processing device 125 may also be coupled to a picture archiving and communications system 128 (PACS).

It should be noted that the monitor 126, the printer 127 and/or other devices supplied within the CT scanner 100 might be arranged local to the computer tomography apparatus 100. Alternatively, these components may be remote from the CT scanner 100, such as elsewhere within an institution or hospital, or in an entirely different location linked to the CT scanner 100 via one or more configurable networks, such as the Internet, virtual private networks and so forth.

Summarising all facts discussed above, it is pointed out that the proposed new electron optical concept, comprising a flat unstructured or even fine-structured flat emitter and two magnetic quadrupole lenses, provides all features necessary for medical X-ray examinations without exceeding geometrical space and weight restrictions due to its small size. The electron optical concept comprises a non-structured or fine structured thin flat emitter and a magnetic double quadrupole lens with dipole coils on the anode-side yoke within a length of 70-90 mm and a total optical length from emitter to target between 120 mm and 150 mm. The 50-60 mm in length between the double quadrupole lens and the target are lens-free and could comprise a scattered-electron-collector (SEC).

This concept can provide e.g. focal spots variable in width between 0.2-1.3 mm with arbitrary values in focal spot length between 0.23-1.45 mm for tube currents of 100-1600 mA and high voltages of 70-140 kV necessary for medical X-ray applications. Additionally it is possible to quickly shift these foci in radial and tangential direction which leads to higher spatial resolutions.

The invention would be applicable to any field in which electrons have to be focused with variable focal spot sizes, shapes and positions combined with high currents but only a limited space for optical elements is available.

It should be noted that the term "comprising" does not exclude other elements or steps and the "a" or "an" does not exclude a plurality. Also elements described in association with different embodiments may be combined. It should also be noted that reference signs in the claims should not be construed as limiting the scope of the claims.

In order to recapitulate the above described embodiments of the present invention one can state: To fulfill the high electron-optical demands for high-end X-ray tubes, a better concept than used in standard tubes is necessary. A solution to reach this is given by the combination of a flat electron emitter and a magnetic double quadrupole with integrated magnetic dipoles. This setup can be realized within an optical length of approximately 130 mm with all focusing elements within the emitter half and is therefore practicable for high-end tubes for CV and CT applications. This electron-optical concept provides the following advantages: 1) focusing high current electron beams into the required line shaped small focal spots with a typical ratio of 7-10 between length and width perpendicular to the optical axis, 2) retaining focusing properties over a large range of kV and mA, 3) independent control of focal spot width and length, and 4) active control of focal spot size and position.

The invention claimed is:

1. An electron optical apparatus comprising components arranged along an optical axis:

a cathode including an emitter, wherein the emitter has a substantially planar surface for homogeneously emitting electrons in an electron beam from the substantially planar surface with a reduced lateral energy component of the emitted electrons transverse to the optical axis;

an anode for accelerating the emitted electrons in a direction essentially along the optical axis;

a first magnetic quadrupole lens for deflecting the accelerated electrons to focus the electron beam and having a first yoke, the first magnetic quadrupole lens further having a magnetic quadrupole gradient for focusing the electron beam in a first direction and defocusing the electron beam in a second direction perpendicular to the first direction;

a second magnetic quadrupole lens for further deflecting the accelerated electrons to focus the electron beam and having a second yoke, the second magnetic quadrupole lens further having a magnetic quadrupole gradient for focusing the electron beam in the second direction and defocusing the electron beam in the first direction, wherein the magnetic quadrupole gradient of the first and second magnetic quadrupole lenses are rotated about 90 degrees with respect to each other, further wherein a sequential combination of the first and second magnetic quadrupole lenses provides a net focusing effect in both first and second directions of a focal spot of the electron beam; and a homogeneous magnetic dipole lens for further deflecting the accelerated electrons of the electron beam in order to shift the focal spot of the electron beam in a plane perpendicular to the optical axis on a target.

2. The apparatus according to claim 1, wherein the magnetic dipole lens comprises dipole coils arranged on the second yoke.

3. The apparatus according to claim 1, further comprising a scattered-electron-collector.

4. The apparatus according to claim 1, wherein each of the components has a symmetry with respect to the optical axis and wherein the components are arranged co-axially with respect to the optical axis.

5. The apparatus according to claim 1, wherein the apparatus has a length along the optical axis of less than 90 mm.

6. The apparatus according to claim 1, wherein the planar surface of the emitter is non-structured, wherein the non-structured surface includes no significant curvatures, openings, or protrusions.

7. The apparatus according to claim 1, wherein the substantially planar surface of the emitter is finely structured, wherein the finely structured surface comprises fine structures within the substantially planar surface that include grooves or recesses having a depth of such fine structures significantly less than dimensions of the substantially planar surface.

8. An X-ray emitting device comprising the following components along an optical axis:

an electron optical apparatus according to claim 1; and an anode disc arranged such that the accelerated electrons impact on an electron receiving surface of the anode disc.

9. The X-ray emitting device according to claim 8, wherein the anode and the anode disc are essentially on a same electric potential.

10. The X-ray emitting device according to claim 8, wherein the anode, the first magnetic quadrupole lens, the second magnetic quadrupole lens, a scattered electron collector and the anode disc are all connected to a water cooling circuit.

11. The X-ray emitting device according to claim 8, wherein a distance from the substantially planar surface of the emitter to the electron receiving surface of the anode disc is less than 150 mm.

12. A medical X-ray device comprising an X-ray emitting device according to claim 8.

13. The apparatus according to claim 1, wherein the homogeneous magnetic dipole lens comprises dipole coils arranged on the second yoke of the second magnetic quadrupole lens, and wherein a magnetic dipole field of the homogeneous magnetic dipole lens is directly superimposed to the magnetic quadrupole field of the second quadrupole lens.

14. A method of creating an electron beam, the method comprising the steps of:

emitting electrons from an emitter, wherein the emitter has a substantially planar surface for homogeneously emitting electrons in an electron beam from the substantially planar surface along an optical axis with a reduced lateral energy component of the emitted electrons transverse to the optical axis;

accelerating the electrons in a direction essentially parallel to an optical axis using an anode;

deflecting the accelerated electrons using a first magnetic quadrupole lens to focus the electron beam, the first magnetic quadrupole lens further having a magnetic quadrupole gradient for focusing the electron beam in a first direction and defocusing the electron beam in a second direction perpendicular to the first direction;

further deflecting the accelerated electrons using a second magnetic quadrupole lens to focus the electron beam, the second magnetic quadrupole lens further having a magnetic quadrupole gradient for focusing the electron beam in the second direction and defocusing the electron beam in the first direction, wherein the magnetic quadrupole gradient of the first and second magnetic quadrupole lenses are rotated about 90 degrees with respect to each other, further wherein a sequential combination of the first and second magnetic quadrupole lenses provides a net focusing effect in both first and second directions of a focal spot of the electron beam; and further deflecting the accelerated electrons of the electron beam using a homogeneous magnetic dipole lens in order to shift the focal spot of the electron beam in a plane perpendicular to the optical axis on a target.

15. The method of claim 14, wherein the homogeneous magnetic dipole lens comprises dipole coils arranged on a yoke of the second magnetic quadrupole lens, and wherein a magnetic dipole field of the homogeneous magnetic dipole lens is directly superimposed to the magnetic quadrupole field of the second quadrupole lens.

* * * * *